US007137680B2

(12) United States Patent
Mataki

(10) Patent No.: US 7,137,680 B2
(45) Date of Patent: Nov. 21, 2006

(54) DROPLET DISCHARGING METHOD AND APPARATUS

(75) Inventor: Hiroshi Mataki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 257 days.

(21) Appl. No.: 10/948,126

(22) Filed: Sep. 24, 2004

(65) Prior Publication Data

US 2005/0099457 A1 May 12, 2005

(30) Foreign Application Priority Data

Sep. 25, 2003 (JP) ..... 2003-333060

(51) Int. Cl.
*B41J 29/38* (2006.01)

(52) U.S. Cl. ..... 347/10; 347/11

(58) Field of Classification Search ..... 347/10
See application file for complete search history.

(56) References Cited

U.S. PATENT DOCUMENTS

| | | | | |
|---|---|---|---|---|
| 5,371,520 | A | 12/1994 | Kubota | |
| 6,099,103 | A | 8/2000 | Takahashi | |
| 6,350,003 | B1 | 2/2002 | Ishikawa | |
| 6,460,959 | B1 * | 10/2002 | Momose et al. | 347/11 |
| 6,851,778 | B1 * | 2/2005 | Okuda | 347/10 |

FOREIGN PATENT DOCUMENTS

| | | | |
|---|---|---|---|
| JP | 01-278357 | A | 11/1989 |
| JP | 01-278358 | A | 11/1989 |
| JP | 02-192947 | A | 7/1990 |
| JP | 10-166579 | A | 6/1998 |
| JP | 11-170515 | A | 6/1999 |
| JP | 11-227203 | A | 8/1999 |

* cited by examiner

*Primary Examiner*—Vip Patel
*Assistant Examiner*—Brian J. Goldberg
(74) *Attorney, Agent, or Firm*—Birch, Stewart, Kolasch & Birch, LLP

(57) ABSTRACT

A droplet discharging method for discharging a liquid inside a pressure chamber as a droplet from a nozzle, by applying a drive waveform to an actuator for causing change in volume of the pressure chamber filled with the liquid, is characterized by that: by taking volume of the pressure chamber as V, taking cross-sectional surface area of the nozzle as A, taking a length of the nozzle as $l_0$, taking a density of the liquid to be discharged as ρ, taking viscosity coefficient of the liquid to be discharged as μ, and taking rate of transmission of a pressure wave transmitted through the liquid inside the pressure chamber as c, these respective factors are established in such a manner that a condition expressed by the following inequality expression is satisfied:

$$\frac{c^2}{V} < \frac{16\pi^2 \cdot \mu^2 \cdot l_0}{A^3 \cdot \rho^2}.$$

19 Claims, 6 Drawing Sheets

DROPLET DISCHARGING METHOD AND APPARATUS

This Non-provisional application claims priority under 35 U.S.C. § 119(a) on Patent Application No(s). 2003-333060 filed in Japan on Sep. 25, 2003, the entire contents of which are hereby incorporated by reference.

BACKGROUND OF THE INVENTION

1. Field of the Invention

The present invention relates to a droplet discharging method and apparatus, and more particularly, to a droplet discharging method and apparatus whereby a liquid, such as ink with high viscosity, or the like, can be discharged at a sufficient speed in the form of a minute droplet, by means of an inkjet method.

2. Description of the Related Art

A droplet discharging apparatus according to an inkjet method records images, or the like, by discharging a liquid, such as ink, or the like, towards a recording medium, as droplets, from nozzles formed on the recording head. There are various ink discharging methods for an ink droplet discharging apparatus based on an inkjet method, and a method is known, for example, whereby the volume of a pressure chamber is caused to change by means of deformation of a piezoelectric ceramic, ink is provided into the pressure chamber from an ink supply passage when the volume is increased, and the ink inside the pressure chamber is discharged from the nozzle as a droplet when the volume of the pressure chamber is reduced.

In an ink droplet discharging apparatus of this kind, in order to increase the resolution of the recording, it is necessary to discharge ink droplets of small volume, and hence various means for achieving this have been implemented. For example, a method is known wherein an ink droplet is torn off, thereby miniaturizing the size of the propelled ink droplet, by pulling back a portion of an ink droplet that is about to be propelled from a nozzle, by applying a subsequent additional drive waveform to an actuator for changing the volume of the pressure chamber, after a drive waveform for discharging ink has been applied (for example, see Japanese Patent Application Publication No. 11-170515).

Moreover, as described above, the drive waveform for discharging ink is applied to the actuator which changes the volume of the pressure chamber, and subsequently, an additional drive waveform for miniaturizing the ink droplet is applied, whereupon a drive waveform for stabilizing the vibrating state of the meniscus face of the ink is further applied, and in such a manner that the speed of the droplet of ink discharged subsequently is prevented from declining (for example, see Japanese Patent Application Publication No. 11-227203).

However, both of the cases disclosed in the reference patents described above are premised on the fact that the ink inside the pressure chamber performs vibration (intrinsic vibration) according to a natural period, ink droplets being miniaturized before discharging by utilizing this intrinsic vibration in the case of the method according to Japanese Patent Application Publication No. 11-170515, and the meniscus face of the ink being stabilized by means of a subsequently applied stabilizing waveform (pulse), as described above, if the viscosity is low due to high temperature, by utilizing this intrinsic vibration, in the case of the method according to Japanese Patent Application Publication No. 11-227203, so that both cases are premised on the intrinsic vibration of the meniscus face, and the discharge timing is controlled by a drive waveform which utilizes this intrinsic vibration, then the design of the drive waveform is subject to temporal restrictions and cycle-related restrictions, and hence improvements are desired.

In general, as the viscosity of a liquid increases, the resisting force directly proportional to the flow rate of the liquid also increases. Consequently, in the case of high viscosity in a conventional ink droplet discharging apparatus as described above, then if a droplet is discharged by driving the actuator under the same drive conditions as a low-viscosity liquid, the speed of the propelled droplet declined in accordance with the aforementioned resisting force. Moreover, if the viscosity of the ink is high, then the refilling of the ink after discharge of the ink droplet will be slow, and consequently, it will take a long time to return to the initial state after discharging of the ink, and hence the recording (printing) speed will decline.

SUMMARY OF THE INVENTION

The present invention is devised with the foregoing in view, an object thereof being to provide a droplet discharging method and apparatus whereby droplets which are minute and have a suitable propulsion speed can be discharged with good efficiency, even in the case of a liquid with high viscosity.

In order to attain the aforementioned object, the present invention is directed to a droplet discharging method for discharging a liquid inside a pressure chamber as a droplet from a nozzle, by applying a drive waveform to an actuator for causing change in volume of the pressure chamber filled with the liquid, wherein by taking volume of the pressure chamber as V, taking cross-sectional surface area of the nozzle as A, taking a length of the nozzle as $l_0$, taking a density of the liquid to be discharged as ρ, taking viscosity coefficient of the liquid to be discharged as μ, and taking rate of transmission of a pressure wave transmitted through the liquid inside the pressure chamber as c, these respective factors are established in such a manner that a condition expressed by the following inequality expression is satisfied:

$$\frac{c^2}{V} < \frac{16\pi^2 \cdot \mu^2 \cdot l_0}{A^3 \cdot \rho^2}.$$

Here, in order to satisfy this condition, the geometrical conditions A, $l_0$ of the head should be designed so as to satisfy the above-defined inequality expression, with respect to the physical values ρ, μand c of the liquid that is to be discharged, for example. By satisfying this condition, when a drive waveform is applied, without creating vibration in the meniscus surface of the liquid, the intrinsic vibration of the meniscus surface does not pose a problem, and hence there are no restrictions with regard to time or period, which means that the head can be driven with good efficiency, without having to take into account the time at which the drive waveform is applied. The present invention is particularly effective in cases where a liquid having a viscosity resistance μ of 30 mPa·sec (30 cP) or above is being discharged.

Preferably, the drive waveform includes a first drive waveform for pulling in meniscus surface of the liquid in the nozzle, a second drive waveform for forming a liquid column in order to discharge the liquid from the nozzle as a droplet, a third drive waveform for forming a minute droplet by breaking the liquid column apart, and a fourth drive waveform for returning the meniscus surface to its initial state after the liquid column has been broken apart. By forming the drive waveform in this manner, it is possible to discharge a liquid as minute droplets, at a satisfactory speed, and to stabilize the meniscus surface rapidly after discharge, even in the case of a liquid of high viscosity.

Preferably, if the drive waveform comprises the first drive waveform, then a time period $t_2$ from a start of the first drive waveform until a start of the second drive waveform is greater than a time period $t_a$ from the start of the first drive waveform until a time at which an absolute value of rate of volume displacement of the meniscus surface reaches a maximum value.

Preferably, by taking compliance of the pressure chamber as C, taking inertance of a liquid flow passage as L, taking liquid viscosity resistance in the nozzle as R, time period $t_a$ is expressed by the following equation:

$$t_a = \frac{1}{2\gamma}\ln\frac{\beta+\gamma}{\beta-\gamma},$$

$$\text{where } \beta = \frac{R}{2L} \text{ and } \gamma = \sqrt{\left(\frac{R}{2L}\right)^2 - \frac{1}{L\cdot C}}.$$

According to the present invention, it is possible to discharge droplets with good efficiency, since the drive waveform for discharging droplets is started when the acceleration of the change in the meniscus surface of the liquid is moving in the discharging direction.

Preferably, rate of volume displacement of the liquid at meniscus surface due to the third drive waveform is less in terms of an absolute value than rate of volume displacement of the liquid at meniscus surface due to the second drive waveform.

Preferably, rate of volume displacement of the liquid at meniscus surface due to the fourth drive waveform is greater in terms of an absolute value than rate of volume displacement of the liquid at meniscus surface due to the third drive waveform.

According to the present invention, in a liquid of high viscosity, it is possible to discharge minute droplets having a speed of a certain level, whilst also being able to cause the meniscus surface after discharge to revert rapidly to its initial state, and hence the recording speed can be increased.

In order to attain the aforementioned object, the present invention is also directed to a droplet discharging apparatus, comprising: a pressure chamber which is filled with a liquid; a nozzle which discharges the liquid provided in the pressure chamber as a droplet; an actuator which causes change in volume of the pressure chamber; and an actuator drive device which applies a drive waveform to the actuator to cause the volume of the pressure chamber to change so as to cause the droplet to be discharged from the nozzle, wherein by taking volume of the pressure chamber as V, taking cross-sectional surface area of the nozzle as A, taking a length of the nozzle as $l_0$, taking a density of the liquid to be discharged as ρ, taking viscosity coefficient of the liquid to be discharged as μ, and taking rate of transmission of a pressure wave transmitted through the liquid inside the pressure chamber as c, these respective factors are established in such a manner that a condition expressed by the following inequality expression is satisfied:

$$\frac{c^2}{V} < \frac{16\pi^2\cdot\mu^2\cdot l_0}{A^3\cdot\rho^2}.$$

Here, in order to satisfy this condition, the geometrical conditions A, $l_0$ to of the head should be designed so as to satisfy the above-defined inequality expression, with respect to the physical values ρ, μ and c of the liquid that is to be discharged, for example. By satisfying this condition, when a drive waveform is applied, without creating vibration in the meniscus surface of the liquid, the intrinsic vibration of the meniscus surface does not pose a problem, and hence the head can be driven with good efficiency without having to take into account the time at which the drive waveform is applied.

Preferably, the drive waveform includes a first drive waveform for pulling in meniscus surface of the liquid in the nozzle, a second drive waveform for forming a liquid column in order to discharge the liquid from the nozzle as a droplet, a third drive waveform for forming a minute droplet by breaking -the liquid column apart, and a fourth drive waveform for returning the meniscus surface to its initial state after the liquid column has been broken apart. By forming the drive waveform in this manner, it is possible to discharge a liquid as minute droplets, at a satisfactory speed, and to stabilize the meniscus surface rapidly after discharge, even in the case of a liquid of high viscosity.

Preferably, if the drive waveform comprises the first drive waveform, then a time period $t_2$ from a start of the first drive waveform until a start of the second drive waveform is greater than a time period $t_a$ from the start of the first drive waveform until a time at which an absolute value of rate of volume displacement of the meniscus surface reaches a maximum value.

Preferably, by taking compliance of the pressure chamber as C, taking inertance of a liquid flow passage as L, taking liquid viscosity resistance in the nozzle as R, time period $t_a$ is expressed by the following equation:

$$t_a = \frac{1}{2\gamma}\ln\frac{\beta+\gamma}{\beta-\gamma},$$

$$\text{where } \beta = \frac{R}{2L} \text{ and } \gamma = \sqrt{\left(\frac{R}{2L}\right)^2 - \frac{1}{L\cdot C}}.$$

According to the present invention, it is possible to discharge droplets with good efficiency, since the drive waveform for discharging droplets is started when the acceleration of the change in the meniscus surface of the liquid is moving in the discharging direction.

As described above, in the droplet discharging method and apparatus relating to the present invention, even in the case of a liquid of high viscosity, the geometric conditions of the head are set so as to achieve a system wherein there is no intrinsic vibration of the meniscus surface, and therefore, the freedom of design of the drive waveforms is increased and it becomes possible to minute discharge droplets having a satisfactory propulsion speed, with good efficiency.

BRIEF DESCRIPTION OF THE DRAWINGS

FIG. 2 shows descriptive diagrams for determining the conditions to prevent vibration of the meniscus surface, wherein

DETAILED DESCRIPTION OF THE PREFERRED EMBODIMENTS

Below, the droplet discharging method and apparatus relating to the present invention are described in detail with reference to the accompanying drawings.

Figure 1:
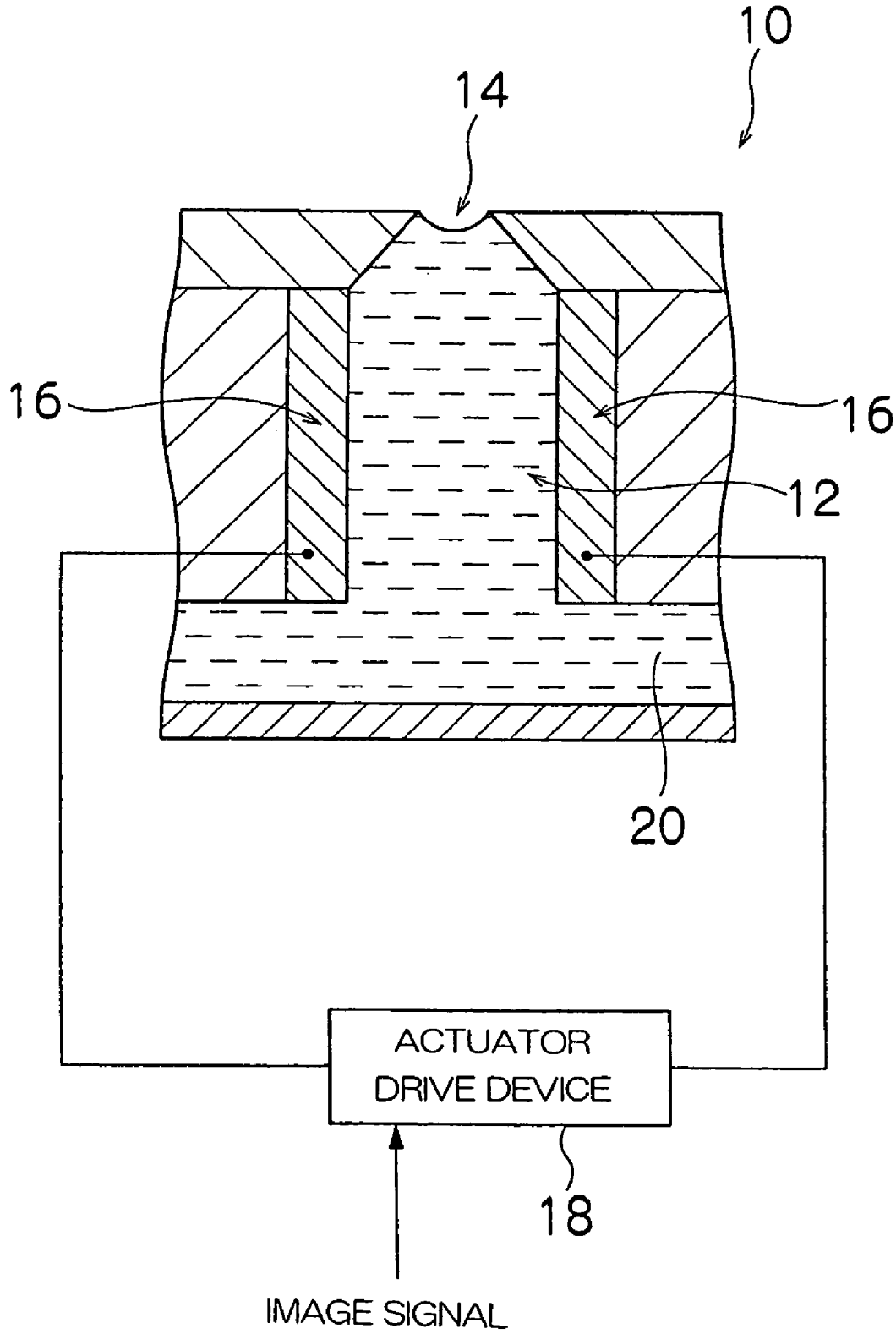
FIG. 1 is a principal cross-sectional diagram showing an approximate view of one embodiment of a droplet discharging apparatus relating to the present invention.

FIG. 1 is a principal cross-sectional diagram showing an approximate view of one embodiment of a droplet discharging apparatus relating to the present invention. As shown in FIG. 1, the droplet discharging apparatus 10 according to the present embodiment comprises: a pressure chamber 12 for accommodating a liquid to be discharged; a nozzle 14 for discharging a liquid provided in one end of the pressure chamber 12, as a droplet; an actuator 16 for changing the volume of the pressure chamber 12 provided in the wall of the pressure chamber 12; an actuator drive device 18 for applying a drive waveform to an actuator 16 in accordance with an image signal; and a liquid supply passage 20, or the like, connected to a liquid tank (not illustrated), for supplying the liquid to the pressure chamber 12 from the liquid tank; or the like.

As shown in FIG. 1, in the present embodiment, the actuator 16 forming a device for generating a liquid discharging pressure for discharging a liquid from the nozzle 14, as a droplet, by changing the volume of the pressure chamber 12 is constituted by a movable element (piezoelectric element) disposed on the wall of the pressure chamber 12 in such a manner that it is driven in a shearing mode, but the actuator 16 is not limited to being a piezoelectric element of this kind and it is possible, for example, to provide a piezoelectric element in the other end portion of the pressure chamber 12 opposing the nozzle 14, causing the volume of the pressure chamber 12 to change by means of deformation of the piezo element, and hence causing a liquid to be discharged as a droplet from the nozzle 14.

The actuator driving means 18 applies a prescribed drive waveform to the actuator 16, on the basis of an input image signal, as described hereinafter, hence causing the movable part of the actuator 16 to move, whereby the volume of the pressure chamber 12 is caused to change and the liquid is discharged as a droplet from the nozzle 14.

The liquid used in the present embodiment is a liquid of high viscosity. This liquid with high viscosity does not cause the meniscus face to vibrate, and does not have a so-called natural period, and more specifically, it is specified by the conditions described below.

The droplet discharging apparatus according to the present embodiment discharges a liquid as a minute droplet, and at a satisfactory discharge speed, in conditions where the viscosity of the liquid is high and the meniscus surface does not vibrate naturally, and next, the conditions whereby there is no vibration of the meniscus surface are described.

Figure 2B:
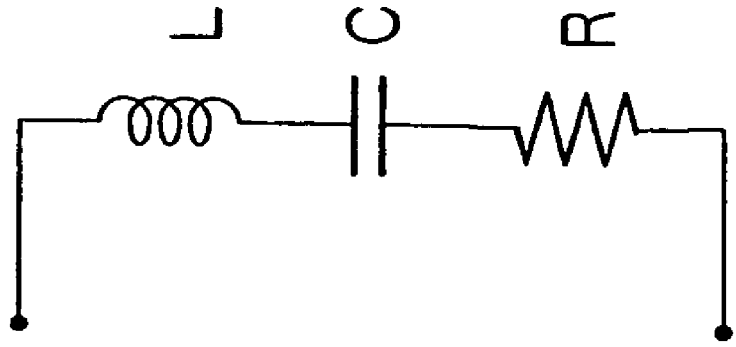
FIG. 2A is a diagram showing a simplified view of a pressure chamber and a nozzle and FIG. 2B is a circuit diagram showing an LCR circuit based on a concentrated constant model.
Figure 2A:
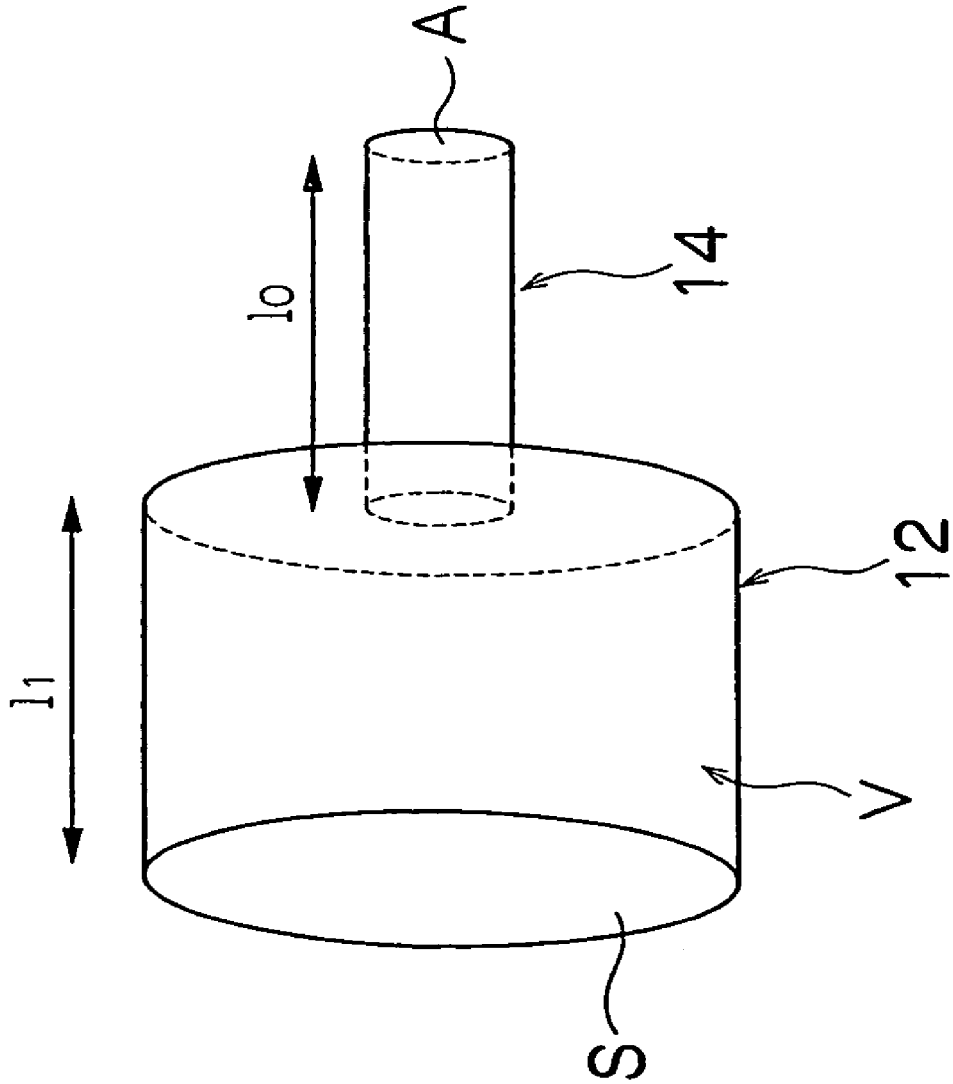

FIG. 2A is a simplified diagram for facilitating the description of the aforementioned pressure chamber 12 and the nozzle 14, each being represented respectively as round bars. As shown in FIG. 2A, the length of the pressure chamber 12 is indicated as $l_1$, the surface area of the base of the pressure chamber 12 is indicated as S, the length of the nozzle 14 is indicated as 10, and the surface area of the base of the nozzle 14 is indicated as A. Hence, the volume of the pressure chamber 12 will be $V=S\cdot l_1$.

Moreover, the compliance of the pressure chamber 12 is indicated as C, the inertance of the liquid flow passage is indicated as L, the resistance in the nozzle section due to the viscosity of the liquid is indicated as R, the density of the discharged liquid is indicated as r, the viscosity coefficient of the discharged liquid is indicated as μ, and the transmission rate of the pressure wave transmitted through the pressure chamber is indicated as c. By using these terms, the compliance C of the pressure chamber 12, the inertance L of the liquid flow passage, and the resistance R at the nozzle section due to the viscosity of the liquid, are expressed respectively as described below:

$$C = \frac{S \cdot l_1}{\rho \cdot c^2} = \frac{V}{\rho \cdot c^2},$$

$$L = \frac{\rho \cdot l_0}{A},$$

$$R = \frac{8\pi \cdot \mu \cdot l_0}{A^2}.$$

Here, in order to consider conditions whereby the meniscus surface does not vibrate, a concentrated constant model based on an LCR series circuit as shown in FIG. 2B is used. In this case, if the current flowing in the LCR series circuit in FIG. 2B is indicated as I, the following equation for damped vibration is obtained:

$$L \cdot \frac{d^2 I}{dt^2} + R \cdot \frac{dI}{dt} + \frac{1}{C} \cdot I = 0.$$

As is well known, the period T of this vibration is expressed by the following equation:

$$T = \frac{4\pi \cdot L}{\sqrt{\frac{4L}{C} - R^2}}.$$

Taking this to be the period of the vibration of the meniscus surface of the ink, the condition whereby the meniscus surface will not vibrate is that T does not exist as a real number, in other words, $$\frac{4L}{C} - R^2 < 0.$$

If the values described above are substituted by $$C = \frac{V}{\rho \cdot c^2},$$

$$L = \frac{\rho \cdot l_0}{A},$$

$$R = \frac{8\pi \cdot \mu \cdot l_0}{A^2},$$

then the following inequality expression (1) is obtained:

$$\frac{c^2}{V} < \frac{16\pi^2 \cdot \mu^2 \cdot l_0}{A^3 \cdot \rho^2}. \quad (1)$$

Figure 3A:
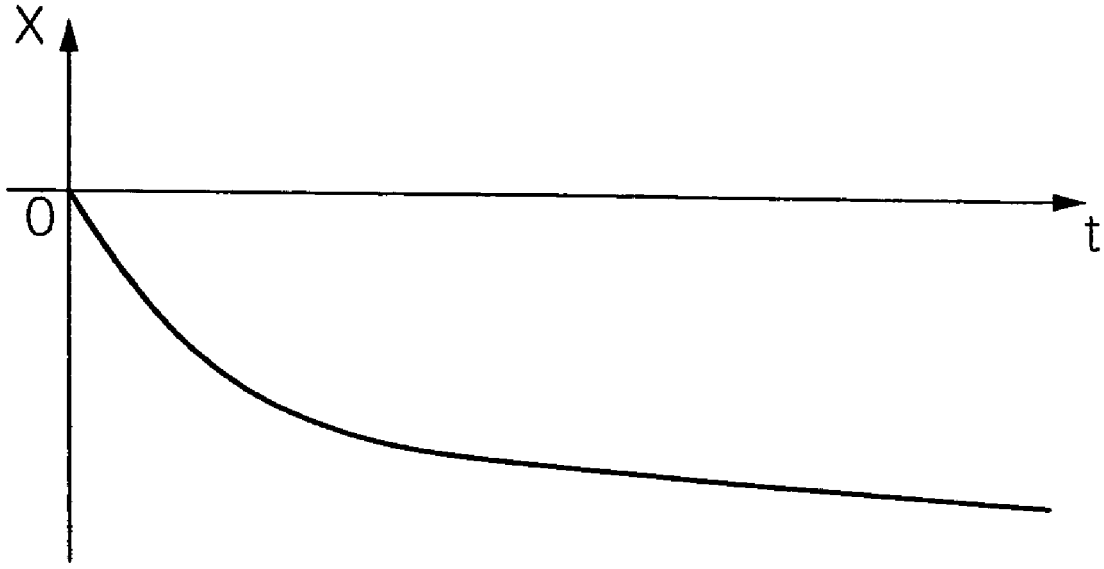
FIG. 3A is a diagram showing the relationship between distance x of the meniscus surface and time t when the inequality expression (1) is effected.

This inequality expression (1) states the condition whereby the meniscus surface of the liquid does not vibrate at all. As the relationship between distance x of the meniscus surface and time t is shown in FIG. 3A, when the inequality expression (1) is effected, the meniscus surface of the liquid is damped completely, without vibrating at all. Consequently, in this case, the meniscus surface does not vibrate, even if a sharp impetus is applied.

Figure 3B:
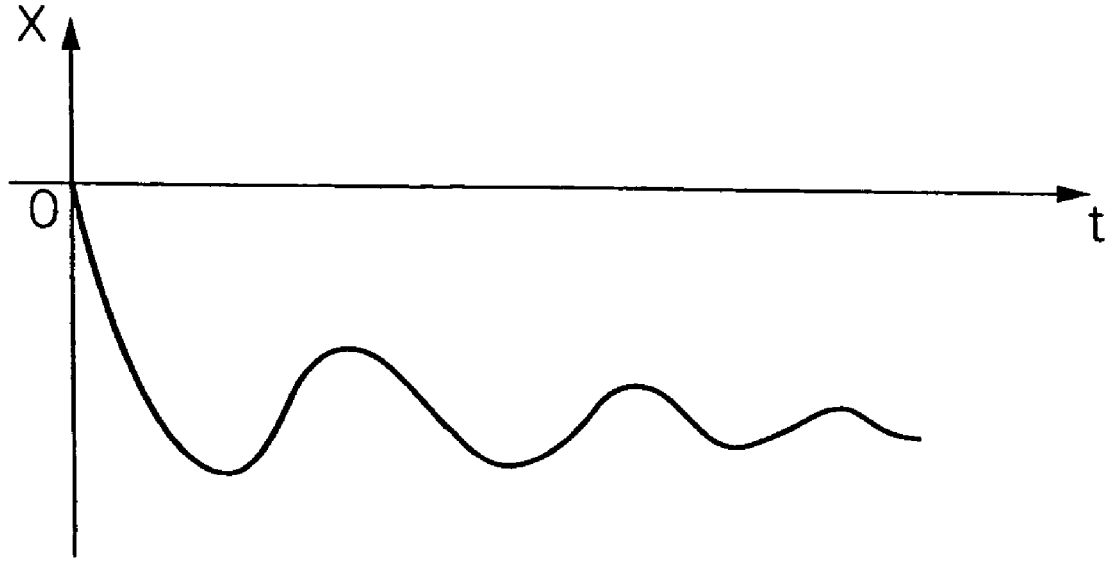
FIG. 3B is a diagram showing the relationship between distance x of the meniscus surface and time t when the inequality expression (1)'.

On the other hand, if the inequality expression (1) is not effected and the following inequality expression (1) is effected:

$$\frac{c^2}{V} < \frac{16\pi^2 \cdot \mu^2 \cdot l_0}{A^3 \cdot \rho^2}, \quad (1)$$

then the meniscus surface of the liquid is vibrated, as the relationship between distance x of the meniscus surface and time t is shown in FIG. 3B.

Furthermore, the equation of the damped vibration obtained by means of the aforementioned concentrated constant model is solved under the aforementioned conditions, taking the rate of volume displacement of the liquid at the meniscus surface to be v.

In other words, the equation $$l \cdot \frac{d^2 l}{dt^2} + R \cdot \frac{dv}{dt^2} + \frac{1}{C} \cdot v = 0$$

is solved under the initial conditions of v=0 and $$\frac{dv}{dt} = -1,$$

when t=0.

In this case, the solution is $$v = \frac{1}{2}\exp\{-(\beta+\gamma)\cdot t\} - \frac{1}{2}\exp\{-(\beta-\gamma)\cdot t\},$$

$$\text{where } \beta = \frac{R}{2L} \text{ and } \gamma = \sqrt{\left(\frac{R}{2L}\right)^2 - \frac{1}{L \cdot C}}.$$

Figure 4A:
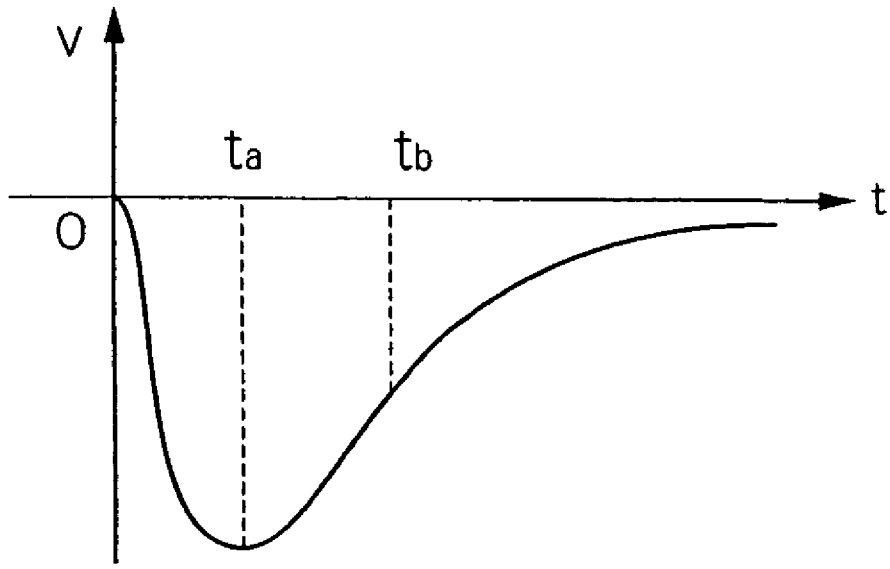
FIG. 4A is a graph showing the rate of volume displacement of a liquid obtained by solving the conditions for preventing vibration.

FIG. 4A shows this solution v in the form of a graph. In FIG. 4A, if the value of t indicated as $t_a$, at which the absolute value of the rate of volume displacement v at the meniscus surface becomes a maximum, is determined, the following equation (2) is obtained:

$$t_a = \frac{1}{2\gamma}\ln\frac{\beta+\gamma}{\beta-\gamma}. \quad (2)$$

Moreover, the value of t indicated as $t_b$, at the turning point in the graph FIG. 4A, in other words, at the point where the rate of change of the rate of volume displacement of the liquid at the meniscus surface changes from an increase to a decrease is given by $$t_b = \frac{1}{2\gamma}\ln\left(\frac{\beta+\gamma}{\beta-\gamma}\right)^2.$$

Figure 4B:
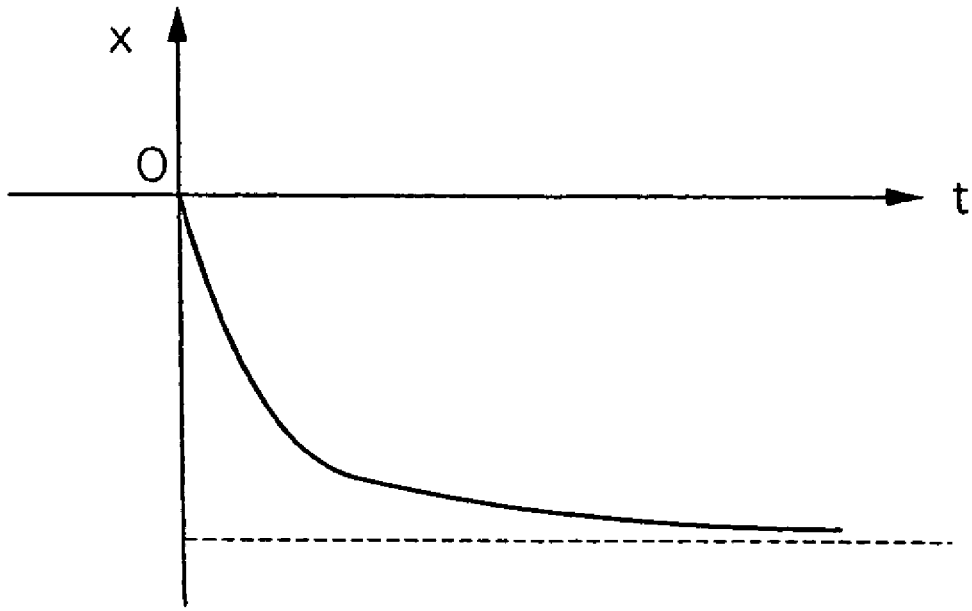
FIG. 4B is a graph showing the displacement of the meniscus surface.

Moreover, the displacement of the meniscus surface x(=∫v·dt) is illustrated in FIG. 4B. As in FIG. 4B, the displacement of the meniscus surface x progresses towards a state of equilibrium, without vibrating, as time t passes.

In the present embodiment, according to the composition described above, a liquid of high viscosity is discharged as a minute droplet, at a satisfactory discharge speed, under the conditions expressed by the inequality expression (1) above whereby the meniscus surface does not vibrate. Below, a drive waveform applied to the actuator 16 by the actuator drive device 18 in order to achieve discharge of this kind is described.

Figure 5:
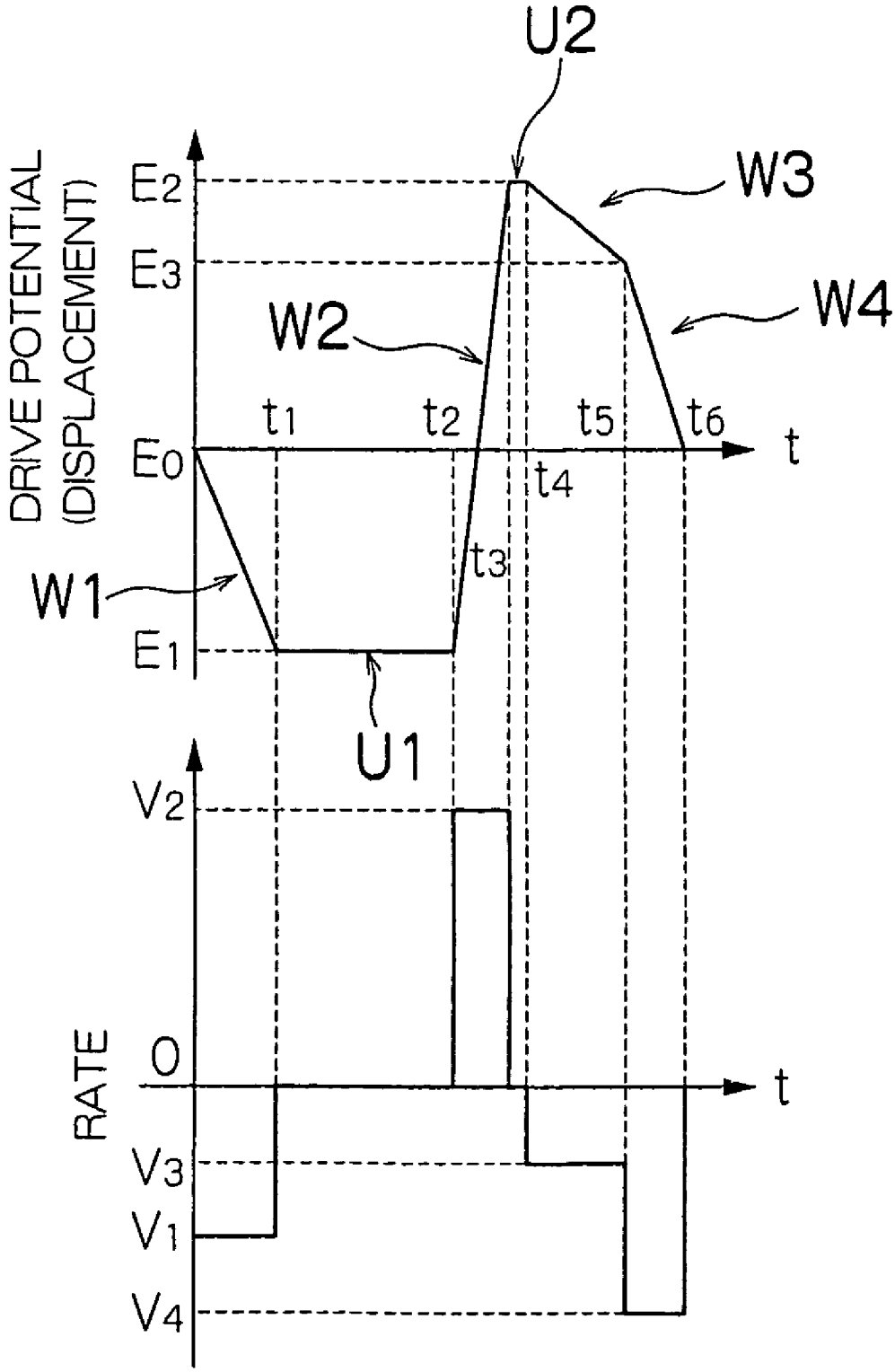
FIG. 5 is a graph showing the drive waveform of the actuator and the rate of volume displacement corresponding to same according to the present embodiment.

FIG. 5 shows a comparison of the drive waveform applied to the actuator 16, and the volume displacement rate v of the liquid at the meniscus surface. As shown in FIG. 5, the drive waveform according to the present embodiment is constituted by a first drive waveform W1, a second drive waveform W2, a third drive waveform W3 and a fourth drive waveform W4, and comprises hold sections U1, U2 in which the drive voltage is held, between the first drive waveform W1 and the second drive waveform W2, and between the second drive waveform W2 and the third drive waveform W3, respectively.

The first drive waveform W1 serves to suction the liquid in order to draw the meniscus surface of the liquid in the nozzle 14 towards the inside. The second drive waveform W2 serves to push the liquid from the nozzle 14, by applying pressure to the liquid in the pressure chamber 12 in order to create a liquid column, and hence cause the liquid to be discharged from the nozzle 14 as a droplet. The third drive waveform W3 serves to create a minute droplet by breaking apart the liquid column created by pushing the liquid from the nozzle 14. Moreover, the fourth drive waveform W4 serves to return the meniscus surface rapidly to its initial state, after breaking apart.

Below, the droplet discharging operation implemented by driving the actuator 16 by means of the actuator drive device 18, using the drive waveform described above, will be described.

From the initial time, t=0 until $t=t_1$, the first drive waveform W1 is applied to the actuator 16. This first drive waveform W1 changes from a reference voltage $E_0$ at t=0, to a voltage $E_1$, in a linear fashion, and the rate v of volume displacement during this, described hereinafter, is a constant value of $v_1$.

In the aforementioned drive waveform graph, the downward direction (the side towards which the voltage decreases) indicates that the liquid in the nozzle 14 is suctioned towards the pressure chamber 12, and the upward direction (the side towards which the voltage increases) indicates that the liquid in the pressure chamber 12 is, conversely, pushed out from the nozzle 14. Moreover, the graph of the drive waveform indicates change in the voltage applied to the actuator 16, but the change in the voltage corresponds with change in the surface of the liquid, and hence this graph can also be regarded as indicating the displacement of the surface of the liquid, at the same time.

Thereupon, from time $t_1$ to $t_2$, the drive voltage is held at a constant value (voltage $E_1$) (hold section U1), and from time $t_2$, a second drive waveform W2 is applied. In this case between times $t_1$ and $t_2$ where the drive voltage is held at a constant value, there is no displacement of the volume of the liquid, and hence the rate of volume displacement is zero.

Moreover, in the example shown in FIG. 4, firstly, the drive waveform is started by applying the first drive waveform W1, but it is not necessarily required to apply this first drive waveform W1. It is also possible to apply the second drive waveform W2 from the prescribed time $t_2$, directly, without applying the first drive waveform W1.

From time $t_2$ to time $t_3$, the second drive waveform W2 is applied, and the voltage is increased in a linear fashion from $E_1$ to $E_2$. Consequently, the rate of volume displacement becomes a large value of $v_2$, the surface of the liquid changes significantly, and the liquid is pushed out from the nozzle 14, thereby forming a liquid column.

Next, in the short time period from time $t_3$ to time $t_4$, the voltage is held at a constant value (hold section U2). In this case, the rate of volume displacement is also zero. Thereupon, from time $t_4$ to time $t_5$, a third drive waveform W3 is applied and the voltage is reduced. In this case, the rate of volume displacement is a constant negative value, namely $V_3$. Due to this third drive waveform W3, the liquid is pulled and the liquid column is broken apart, thereby forming a liquid droplet, which is projected towards the recording medium.

Finally, from time $t_5$ until $t_6$, the fourth drive waveform W4 is applied. This fourth drive waveform W4 reduces the voltage from $E_3$ until the reference voltage $E_0$. In this case, the rate of volume displacement is negative and the absolute value thereof is a large value. By this means, the liquid is pulled further, and hence the liquid surface is stabilized rapidly after breaking the liquid column apart, and forming and discharging a droplet.

In the droplet discharging apparatus 10 according to the present embodiment, the actuator 16 is driven by a drive waveform of this kind by means of an actuator drive device 18, and a liquid with high viscosity is discharged as a minute droplet at a satisfactory speed. Here, as described previously, it is also possible to omit application of the first drive waveform W1, but if the first drive waveform W1 is applied, then desirably, the time period $t_2$ from the start of application of the first drive waveform W1 until the start of the second drive waveform W2, is determined as follows.

More specifically, as shown in FIG. 4A, the rate v of displacement of the surface of the liquid decreases in the range of $0<t<t_a$, and hence the acceleration is negative, whereas when $t>t_a$, the rate of displacement v starts to increase, and the acceleration becomes positive. Moreover, it is considered to be more efficient if a pressing force is applied and the liquid is discharged as a droplet when the acceleration of the displacement of the surface of the liquid is positive.

Figure 6A:
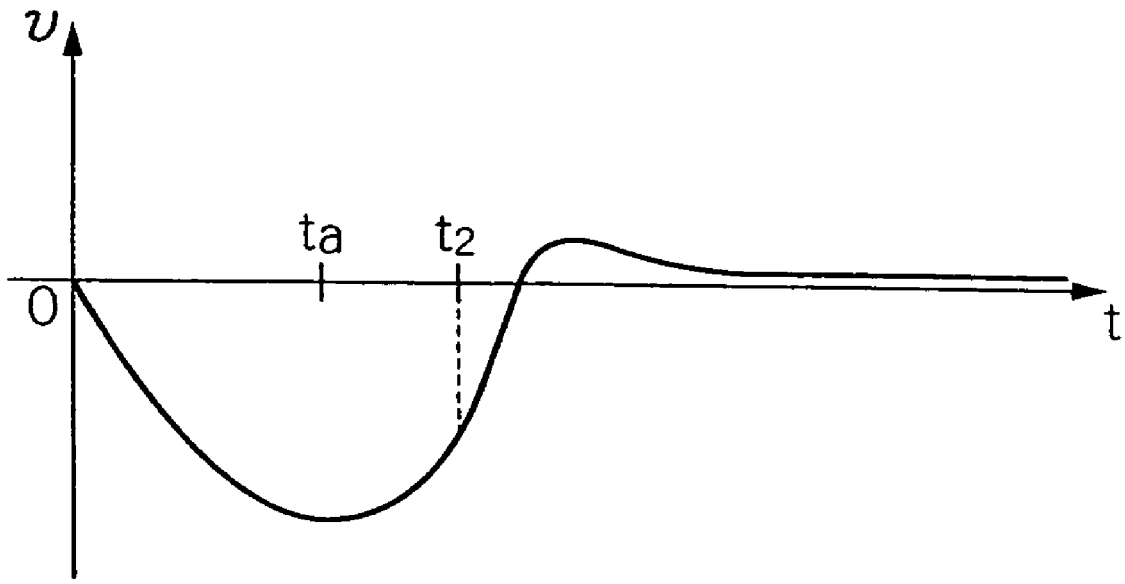
FIG. 6A is a diagram showing the relationship between the rate v of meniscus surface and time t when the acceleration of meniscus surface distance is positive.

Under the conditions whereby the surface of the liquid does not vibrate at high viscosity, if the time period $t_2$ at which application of the second drive waveform W2 for discharging the liquid as a droplet is set such that $t_2>t_a$, it can be seen that it will be possible to discharge the liquid as a droplet in an efficient manner because the acceleration of meniscus surface distance is positive, as the relationship between the rate v of meniscus surface and time t is shown in FIG. 6A.

Since $$t_a = \frac{1}{2\gamma}\ln\frac{\beta+\gamma}{\beta-\gamma}$$

as calculated above, then the condition $t_2>t_a$ can be expressed by the following inequality expression (3):

$$t_2 > \frac{1}{2\gamma}\ln\frac{\beta+\gamma}{\beta-\gamma}. \tag{3}$$

Figure 6B:
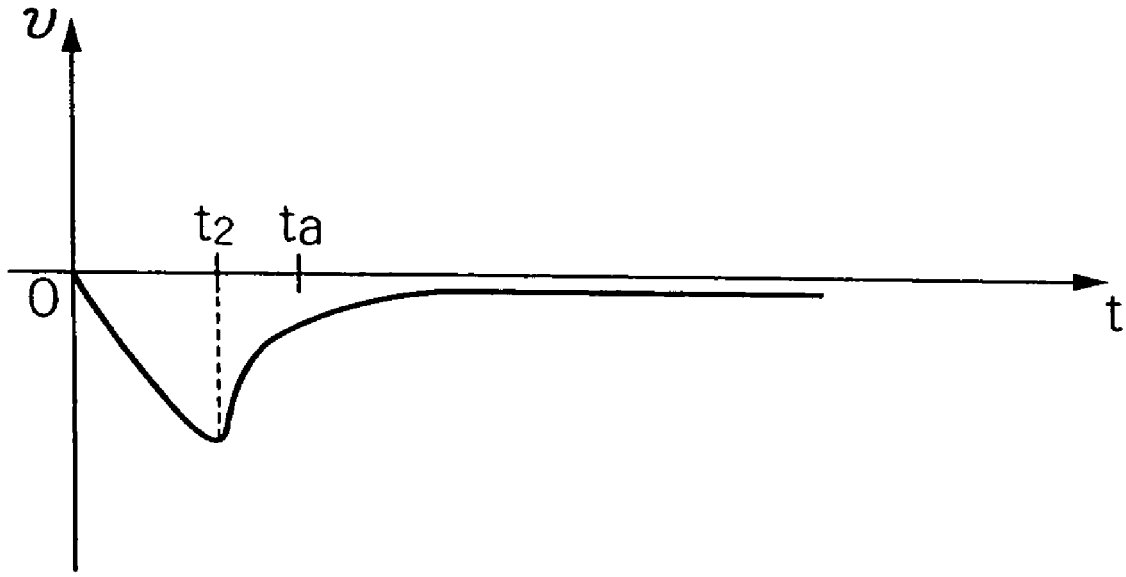
FIG. 6B is a diagram showing the relationship between the rate v of meniscus surface and time t when the acceleration of meniscus surface distance is negative.

On the other hand, if the time period $t_2$ is set such that $t_2<t_a$, it is difficult to discharge the liquid in an efficient manner because the acceleration of meniscus surface distance is negative, as the relationship between the rate v of meniscus surface and time t is shown in FIG. 6B.

Moreover, it is most desirable if the acceleration of the displacement of the surface of the liquid is a maximum value during this. As can be seen from the graph in FIG. 4A, in this case, the acceleration reaches a maximum at the turning point $t_b$. Therefore, desirably, the time period $t_2$ until the liquid starts to be pushed, immediately after the liquid starts to be suctioned, is indicated as the position of the turning point $t_b$, where the acceleration of the displacement of the liquid surface becomes a maximum.

More specifically, since $$t_b = \frac{1}{2\gamma}\ln\left(\frac{\beta+\gamma}{\beta-\gamma}\right)^2$$

as calculated above, it is most desirable if $t_2$ is indicated as the time period determined by the following equation:

$$t_2 = \frac{1}{2\gamma}\ln\left(\frac{\beta+\gamma}{\beta-\gamma}\right)^2.$$

Alternatively, the time period $t_2-t_1$, from immediately after the end of application of the first drive waveform W1 until the application of the second drive waveform W2 may be taken as the turning point $t_b$ at which the acceleration becomes a maximum, as indicated in the following equation $$t_2 - t_1 = \frac{1}{2\gamma}\ln\left(\frac{\beta+\gamma}{\beta-\gamma}\right)^2.$$

In this way, desirably, the liquid is pushed out at a time after the point $t_a$ at which the rate of volume displacement of the liquid reaches a maximum, and more desirably, the liquid is pushed out at a time corresponding to the turning point $t_b$ of the rate of displacement, where the acceleration of the volume displacement of the liquid reaches a maximum.

Furthermore, in order that the liquid column formed by the application of the second drive waveform W2 is pulled back and a minute droplet is propelled at a satisfactory speed, the third drive waveform W3 is desirably set in such a manner that the gradient thereof in the graph shown in FIG. 5, is lower in absolute terms than the gradient of the second drive waveform W2. More specifically, in terms of the graph of the volume displacement rate at the bottom of FIG. 5, the rate of volume displacement $V_3$ corresponding to the third drive waveform W3 is designed to be lower in absolute terms than the rate of volume displacement $v_2$ corresponding to the second drive waveform W2, as indicated as the following inequality expression (4):

$$|v_2|>|v_3|. \tag{4}$$

This is because, if $|v_2|$ is greater than $|v_3|$, then in the case of a liquid with high viscosity, the force pulling back on the droplet that is sought to be separated from the liquid column and discharged will become very large, and hence the speed of propulsion of the discharged droplet will be low.

Consequently, by means of aforementioned condition, it is possible to discharge minute droplets having a speed of a certain level, from a liquid of high viscosity.

Moreover, desirably, the relationship between the third drive waveform W3 and the fourth drive waveform W4 is set in such a manner that, in the gradient of the graph in FIG. 5, the gradient of the fourth drive waveform W4 is greater in absolute terms than the gradient of the third drive waveform W3. More specifically, in terms of the graph of the volume displacement rate at the bottom of FIG. 5, desirably, the rate of volume displacement $V_3$ corresponding to the third drive waveform W3 is greater in absolute terms than the rate of volume displacement $V_4$ corresponding to the fourth drive waveform W4, as indicated as the following inequality expression (5):

$$|v_4|>|v_3|. \tag{5}$$

In this way, the meniscus surface of the liquid can be stabilized and returned to its initial state, after the liquid column has been broken apart and a liquid droplet has been discharged. In the case of a conventional liquid of low viscosity, since the surface of the liquid vibrates, if it sought to stabilize the liquid rapidly by constricting it, this may conversely cause additional vibration and not lead to the desired stabilization, and hence the intrinsic vibration of the liquid surface must be taken into account when determining the time at which the liquid is to be constricted, but in the present case, the liquid is of high viscosity and does not vibrate, and hence it is desirable to constrict the liquid as rapidly as possible.

More specifically, it is preferable that the time period between the third drive waveform W3 and the fourth drive waveform W4 is as short as possible. In this way, according to the present embodiment, since the conditions are set whereby no vibration in the liquid surface occurs when a liquid of high viscosity is used, then there are absolutely no restrictions relating to time, and hence time does not need to be taken into account and the surface of the liquid can be stabilized rapidly by applying the fourth drive waveform W4 for constricting the liquid, straight away. Consequently, it is possible to perform the next printing operation, in an immediately subsequent fashion, and it is possible to increase the printing speed.

Moreover, desirably, the time period $t_4-t_3$ of the hold section U2 during which the voltage is held, between the second drive waveform W2 and the third drive waveform W3, is as short as possible, in order to form a minute droplet. If this time period is long, then the discharged droplet will become larger. Depending on the circumstances, this time period may be set to zero, and the hold section U2 omitted altogether.

Furthermore, in contrast to this, by changing the time period of the hold section U2, in other words, the time at which the third drive waveform W3 starts, so that it arrives earlier or later, it is also possible to perform droplet ejection adjustment whereby the size of the droplet is adjusted by changing the position of the drive waveform which breaks the liquid column apart.

Moreover, above, it was supposed that, desirably, the third drive waveform W3 is set so as to have a lower gradient in absolute terms, in the graph shown in FIG. 4, than the gradient of the second drive waveform W2, but in order to increase the breaking effect and facilitate the creation of minute droplets, it is desirable that the gradient of the third drive waveform W3 is as high as possible, whilst satisfying the condition of being lower than that of the second drive waveform W2. In other words, desirably, the rate of volume displacement $|v_3|$ relating to the third drive waveform W3 should be as rapid ( large) as possible.

As described above, according to the present embodiment, it is possible to discharge a liquid of high viscosity in the form of a minute droplet having a satisfactory speed, by ensuring that the rate of volume displacement relating to a drive waveform for discharging the liquid as a droplet is greater than the rate of volume displacement relating to a drive waveform for breaking the liquid apart.

Moreover, it is also possible to achieve a short time period until the meniscus surface returns to its initial state, by ensuring that the rate of volume displacement relating to a drive waveform for returning the meniscus surface to its initial state is greater than the rate of volume displacement relating to a drive waveform for breaking the liquid apart, and hence the next print operation can be started immediately and the speed of printing can be increased.

The droplet discharging method and apparatus according to the present invention have been described in detail above, but the present invention is not limited to the aforementioned examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet discharging method for discharging a liquid inside a pressure chamber as a droplet from a nozzle, by applying a drive waveform to an actuator for causing change in volume of the pressure chamber filled with the liquid, wherein by taking volume of the pressure chamber as V, taking cross-sectional surface area of the nozzle as A, taking a length of the nozzle as $l_0$, taking a density of the liquid to be discharged as ρ, taking viscosity coefficient of the liquid to be discharged as μ, and taking rate of transmission of a pressure wave transmitted through the liquid inside the pressure chamber as c, these respective factors are established in such a manner that a condition expressed by the following inequality expression is satisfied:

$$\frac{c^2}{V} < \frac{16\pi^2 \cdot \mu^2 \cdot l_0}{A^3 \cdot \rho^2}.$$

2. The droplet discharging method as defined in claim 1, wherein the drive waveform includes a first drive waveform for pulling in meniscus surface of the liquid in the nozzle, a second drive waveform for forming a liquid column in order to discharge the liquid from the nozzle as a droplet, a third drive waveform for forming a minute droplet by breaking the liquid column apart, and a fourth drive waveform for returning the meniscus surface to its initial state after the liquid column has been broken apart.

3. The droplet discharging method as defined in claim 2, wherein rate of volume displacement of the liquid at meniscus surface due to the fourth drive waveform is greater in terms of an absolute value than rate of volume displacement of the liquid at meniscus surface due to the third drive waveform.

4. The droplet discharging method as defined in claim 2, wherein rate of volume displacement of the liquid at meniscus surface due to the third drive waveform is less in terms of an absolute value than rate of volume displacement of the liquid at meniscus surface due to the second drive waveform.

5. The droplet discharging method as defined in claim 4, wherein rate of volume displacement of the liquid at meniscus surface due to the fourth drive waveform is greater in terms of an absolute value than rate of volume displacement of the liquid at meniscus surface due to the third drive waveform.

6. The droplet discharging method as defined in claim 2, wherein, if the drive waveform comprises the first drive waveform, then a time period $t_2$ from a start of the first drive waveform until a start of the second drive waveform is greater than a time period $t_a$ from the start of the first drive waveform until a time at which an absolute value of rate of volume displacement of the meniscus surface reaches a maximum value.

7. The droplet discharging method as defined in claim 6, wherein rate of volume displacement of the liquid at meniscus surface due to the fourth drive waveform is greater in terms of an absolute value than rate of volume displacement of the liquid at meniscus surface due to the third drive waveform.

8. The droplet discharging method as defined in claim 6, wherein rate of volume displacement of the liquid at meniscus surface due to the third drive waveform is less in terms of an absolute value than rate of volume displacement of the liquid at meniscus surface due to the second drive waveform.

9. The droplet discharging method as defined in claim 8, wherein rate of volume displacement of the liquid at meniscus surface due to the fourth drive waveform is greater in terms of an absolute value than rate of volume displacement of the liquid at meniscus surface due to the third drive waveform.

10. The droplet discharging method as defined in claim 6, wherein by taking compliance of the pressure chamber as C, taking inertance of a liquid flow passage as L, taking liquid viscosity resistance in the nozzle as R, time period $t_a$ is expressed by the following equation:

$$t_a = \frac{1}{2\gamma}\ln\frac{\beta+\gamma}{\beta-\gamma}, \text{ where } \beta = \frac{R}{2L} \text{ and } \gamma = \sqrt{\left(\frac{R}{2L}\right)^2 - \frac{1}{L \cdot C}}.$$

11. The droplet discharging method as defined in claim 10, wherein rate of volume displacement of the liquid at meniscus surface due to the fourth drive waveform is greater in terms of an absolute value than rate of volume displacement of the liquid at meniscus surface due to the third drive waveform.

12. The droplet discharging method as defined in claim 4, wherein rate of volume displacement of the liquid at meniscus surface due to the third drive waveform is less in terms of an absolute value than rate of volume displacement of the liquid at meniscus surface due to the second drive waveform.

13. The droplet discharging method as defined in claim 12, wherein rate of volume displacement of the liquid at meniscus surface due to the fourth drive waveform is greater in terms of an absolute value than rate of volume displacement of the liquid at meniscus surface due to the third drive waveform.

14. A droplet discharging apparatus, comprising:

a pressure chamber which is filled with a liquid;

a nozzle which discharges the liquid provided in the pressure chamber as a droplet;

an actuator which causes change in volume of the pressure chamber; and an actuator drive device which applies a drive waveform to the actuator to cause the volume of the pressure chamber to change so as to cause the droplet to be discharged from the nozzle, wherein by taking volume of the pressure chamber as V, taking cross-sectional surface area of the nozzle as A, taking a length of the nozzle as $l_0$, taking a density of the liquid to be discharged as ρ, taking viscosity coefficient of the liquid to be discharged as μ, and taking rate of transmission of a pressure wave transmitted through the liquid inside the pressure chamber as c, these respective factors are established in such a manner that a condition expressed by the following inequality expression is satisfied:

$$\frac{c^2}{V} < \frac{16\pi^2 \cdot \mu^2 \cdot 1_0}{A^3 \cdot \rho^2}.$$

15. The droplet discharging apparatus as defined in claim 14, wherein rate of volume displacement of the liquid at meniscus surface due to the third drive waveform is less in terms of an absolute value than rate of volume displacement of the liquid at meniscus surface due to the second drive waveform.

16. The droplet discharging apparatus as defined in claim 14, wherein rate of volume displacement of the liquid at meniscus surface due to the fourth drive waveform is greater in terms of an absolute value than rate of volume displacement of the liquid at meniscus surface due to the third drive waveform.

17. The droplet discharging apparatus as defined in claim 14, wherein the drive waveform includes a first drive waveform for pulling in meniscus surface of the liquid in the nozzle, a second drive waveform for forming a liquid column in order to discharge the liquid from the nozzle as a droplet, a third drive waveform for forming a minute droplet by breaking the liquid column apart, and a fourth drive waveform for returning the meniscus surface to its initial state after the liquid column has been broken apart.

18. The droplet discharging apparatus as defined in claim 17, wherein, if the drive waveform comprises the first drive waveform, then a time period $t_2$ from a start of the first drive waveform until a start of the second drive waveform is greater than a time period $t_a$ from the start of the first drive waveform until a time at which an absolute value of rate of volume displacement of the meniscus surface reaches a maximum value.

19. The droplet discharging apparatus as defined in claim 18, wherein by taking compliance of the pressure chamber as C, taking inertance of a liquid flow passage as L, taking liquid viscosity resistance in the nozzle as R, time period $t_a$ is expressed by the following equation:

$$t_a = \frac{1}{2\gamma}\ln\frac{\beta+\gamma}{\beta-\gamma}, \text{ where } \beta = \frac{R}{2L} \text{ and } \gamma = \sqrt{\left(\frac{R}{2L}\right)^2 - \frac{1}{L \cdot C}}.$$

* * * * *